United States Patent [19]

Nishizako

[11] 4,367,448

[45] Jan. 4, 1983

[54] DIRECT CURRENT ELECTROMAGNETIC CONTACTOR

[75] Inventor: Shizutaka Nishizako, Nagoya, Japan

[73] Assignee: Mitsubishi Denki Kabushiki Kaisha, Japan

[21] Appl. No.: 277,644

[22] Filed: Jun. 26, 1981

[30] Foreign Application Priority Data

Jun. 27, 1980 [JP] Japan ..... 55/87319

[51] Int. Cl.[3] ..... H01H 33/18

[52] U.S. Cl. ..... 335/201; 200/147 A

[58] Field of Search ..... 335/201; 200/147 A

[56] References Cited

U.S. PATENT DOCUMENTS 2,836,685 5/1958 Pettit ..... 335/201

3,090,854 5/1963 Kretschmar ..... 200/147

FOREIGN PATENT DOCUMENTS 1361227 4/1964 France ..... 200/147 A

*Primary Examiner*—Harold Broome

*Attorney, Agent, or Firm*—Robert E. Burns; Emmanuel J. Lobato; Bruce L. Adams

[57] ABSTRACT

A direct current electromagnetic contactor has three pairs of separable contacts each comprised of stationary and movable contacts. An electromagnetic device effects movement of the movable contacts between open and closed positions relative to the stationary contacts. An arc-extinguishing device includes at least one pair of permanent magnets having mutually opposing magnetic pole faces. The permanent magnets are positioned proximate the separable contact pairs with their pole faces of opposite magnetic polarities facing each other and defining therebetween an air gap. One of the three separable contact pairs is disposed within the air gap such that the magnetic flux lines between the two opposing permanent magnets extend perpendicular to the direction of movement of the movable contact or an electric arc between the separated contacts. The two other separable contact pairs are disposed within a space defined between planes including each magnetic pole face of each permanent magnet such that the magnetic flux lines extending through the separated contact pairs extend perpendicular to electric arcs established therebetween.

17 Claims, 13 Drawing Figures

DIRECT CURRENT ELECTROMAGNETIC CONTACTOR

BACKGROUND OF THE INVENTION

1. Field of the Invention

This invention relates to improvements to direct current electromagnetic contactors equipped with magnetic arc-extinguishing means.

2. Description of the Prior Art

Heretofore, direct current electromagnetic contactors with magnetic arc-extinguishing means have typically comprised a stationary coil resiliently mounted in an insulating base and surrounded by a coil to which electric power may be supplied to energize the coil and generate an electromagnetic force in the stationary core, which thereby attracts a movable core which is mechanically linked to a cross-bar means supporting normally closed and/or normally open contact sets which switch DC currents flowing in a main circuit. The normally closed or normally open contact sets are respectively switched to the opposite state by the movement of the cross-bar due to the electromagnetic attraction between the stationary core and the movable core when the coil surrounding the stationary core is energized. The same contacts are returned to their normal states when the coil is deenergized to cease the electromagnetic force and release the movable core and the cross-bar to be returned to their original positions by the force of a return spring.

On the occasion of the opening of any of the contact sets, either by opening the normally closed contacts, or opening the normally open contacts after they have been closed by movement of the cross-bar, it is usual that an arc will be produced between the opening contacts. This arc, if not controlled, can damage the contacts and may interfere with or prevent the interruption being effected. Therefore the prior art typically included magnetic arc-extinguishing devices each consisting of a permanent magnet surrounded by a protective sleeve for protecting the permanent magnet against arc damage, with pole plates sandwiching and supporting the permanent magnet at right angles to the direction of magnetization, and a connecting spar linking the two pole plates.

By virtue of provision of these magnetic arc-extinguishing devices, the arcs that are produced at right angles to the direction of the magnetic field formed by the permanent magnets, in accordance with Fleming's left-hand rule, and are thus drawn out and extinguished.

However, in a prior device of the construction described above, the number of parts making up the magnetic arc-extinguishing devices is great, and as a magnetic arc extinguishing device must be disposed for each set of normally open or normally closed contacts, the drawback of a high basic cost arises. Further, the various contacts of the normally open and the normally closed contact sets are closely adjacent to the pole plates of the magnetic arc-extinguishing devices and so a metal vapor of the contact material, etc., produced during arcing, causes a reduction in the dielectric strength in the space around the contacts such that the arc may transfer to the pole plates, and in these circumstances, the arc cease to be perpendicular to the flux of the permanent magnet, as a result of which the arc driving force is reduced whereby it may become impossible to effect interruption and the heat produced by the arc may burn the surrounding insulator, such as the frame, with the fear of momentary short circuits. Furthermore, with an increase in current or raised voltage, these problems are magnified, and become more frequent, leading to reduced interruption performance and shortened switching life.

SUMMARY OF THE INVENTION

It is accordingly an object of this invention to provide a direct current electromagnetic contactor including a magnetic arc-extinguishing means of a reduced number of parts and a simplified construction as compared with the typical construction of the prior art.

It is another object of this invention to present a direct current electromagnetic contactor in which the number of magnetic arc-extinguishing devices is reduced.

It is a further object of this invention to present a direct current electromagnetic contactor of outstanding arc interruption performance.

It is still a further object of this invention to present a direct current electromagnetic contactor which combines high arc interruption performance and compact dimensions.

It is yet another object of this invention to provide a direct current electromagnetic contactor of outstanding arc cooling efficiency.

According to the present invention, a direct current electromagnetic contactor comprises, in an insulating housing, a set of three pairs of separable contacts, each pair including stationary and movable contacts and being connectable to an external circuit to be controlled. The movable contacts of the contact pairs are movably supported by a supporting means between closed and open positions relative to the stationary contacts, and the supporting means is operatively coupled to an operating means including an electromagnetic device so that the movable contacts are moved between the closed and open positions in response to energization and deenergization of the electromagnetic device. The electromagnetic contactor further includes magnetic arc blowout means including at least one pair of permanent magnets having mutually opposing magnetic pole faces. The permanent magnets are positioned in the proximity of the separable contact pairs so that their pole faces having different magnetic polarities face each other and that an air gap is defined between the facing magnetic faces. One of the three separable contact pairs is positioned within the air gap so that the magnetic flux lines between the two opposing permanent magnets are perpendicular to the direction of movement of the movable contact or an electric arc between the separated contacts. Two other separable contact pairs are positioned within a spaced define between planes including each magnetic pole face of each permanent magnet. These separable contact pairs are also positioned so that the flux lines extending through the separated contacts pairs are perpendicular to electric arcs established therebetween.

In one embodiment of the present invention, three electrically conductive bridging contact arms are provided, and each bridging contact arm carries two movable contacts at the opposite ends, thus forming two contact pair sets. The magnetic fluxes necessary for blowing out the electric arc are provided by two pairs of the permanent magnets.

The electromagnetic contactor may be provided with pivotable contact arms. The separable contact pairs may all be either the normally-open type or the normally-closed type or a combination of these types may be employed.

DESCRIPTION OF THE PREFERRED EMBODIMENTS

Figure 1:
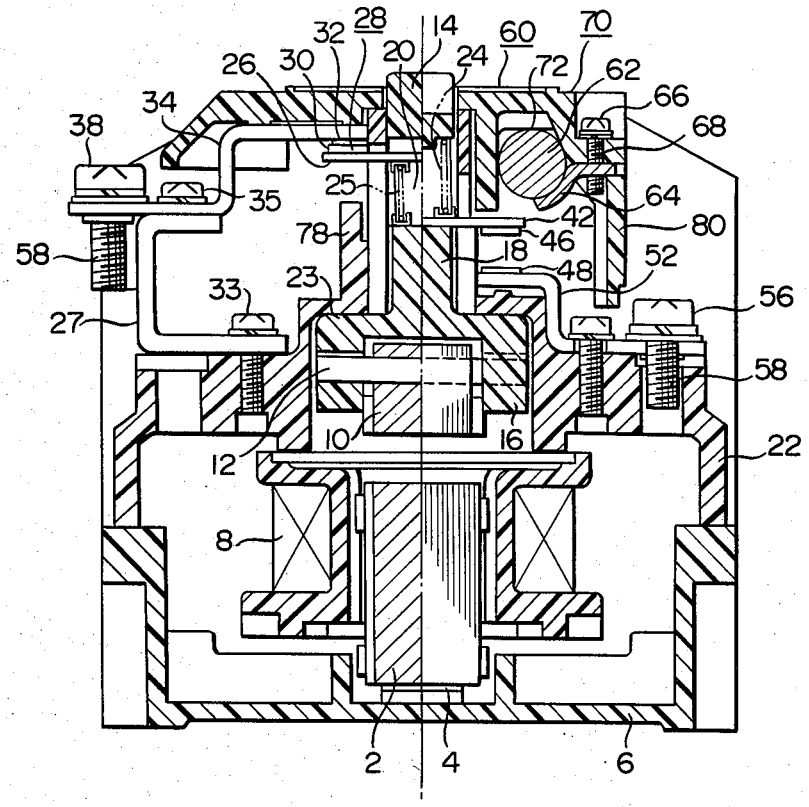
FIG. 1 is a staggered vertical sectional view of a direct current electromagnetic contactor according to the present invention, taken along the line I—I in FIG. 2.
Figure 2:
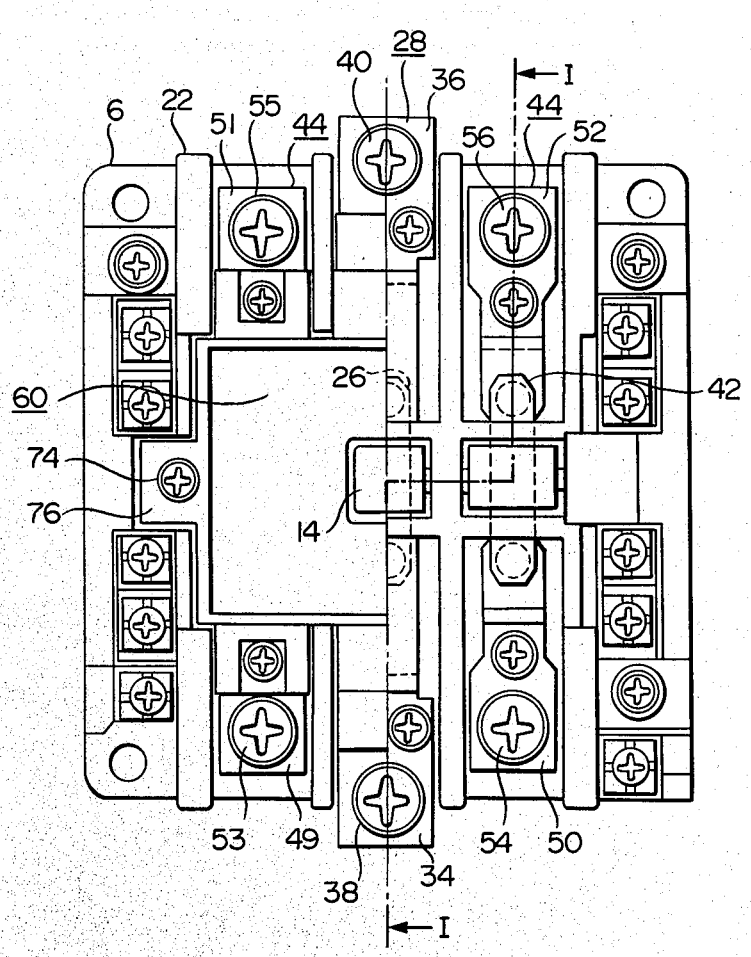
FIG. 2 is a plan view of a direct current electromagnetic contactor according to the present invention shown with the right-hand portion of the cover removed.
Figure 3:
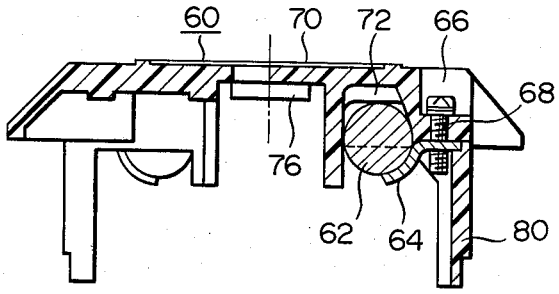
FIG. 3 is a staggered vertical sectional view of a magnetic arc extinguishing means according to this invention taken along the line III—III in FIG. 4.
Figure 4:
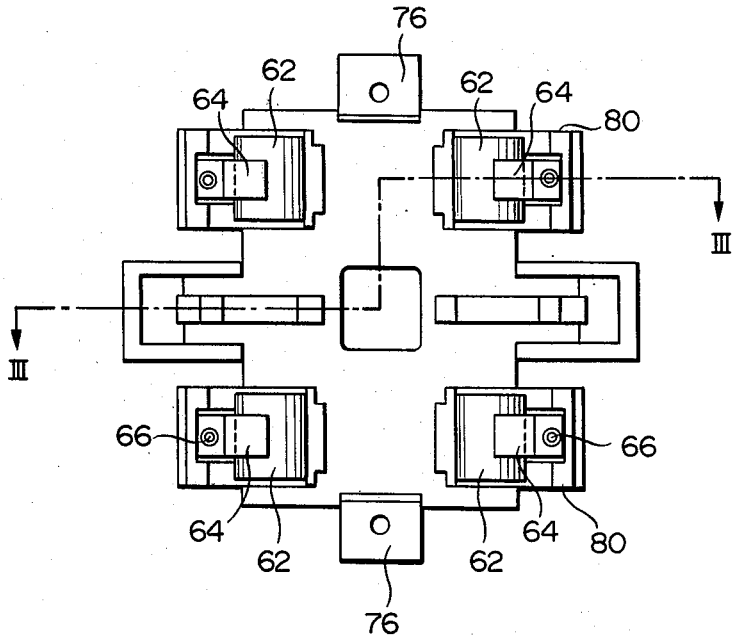
FIG. 4 is a bottom view of the magnetic arc-extinguishing means shown in FIG. 3.

Referring now to the drawings, FIGS. 1 and 2 show a direct current electromagnetic contactor according to the present invention, wherein a stationary core 2 mounted on a shock absorbing spring 4 is resiliently supported in a base 6 of an insulating material such as a synthetic resin, and wound round the stationary core 2 is a coil 8 switchably connected to a power source (not shown). Disposed opposite the stationary core 2 and electromagnetically cooperative therewith is a movable core 10 supported by a pin 12 in a yoke portion 16 of a cross-bar 14, the cross-bar 14 being slidably supported in a frame 22 of an insulating material such as a synthetic resin, and supported such that the movable core 10 is normally held at a fixed distance away from the stationary core 2, by means of a return spring (not shown). The cross-bar 14 is held under the tension of the return spring with the side of the yoke portion 16 away from the stationary core 2 (the upper side in FIG. 1), which yoke portion extrudes laterally beyond the periphery of the shaft, pressed against a retaining flange or surface 23 incorporated in the frame 22. Resiliently supported in a window 20 in the shaft portion 18 of the cross-bar 14, by means of compression springs 24 which apply a contact force in the closed circuit state, is a movable contact arm 26 of an electrically conductive material across the central longitudinal axis of the cross-bar 14 and carrying at each end thereof on the surface thereof facing away from the stationary core 2 (the upper side in FIG. 1), movable contacts 30 of a normally closed contact set 28, which is normally maintained in the closed state with the movable contacts 30 in contact with stationary contacts 32 individually supported on the surfaces of conducting members 34 and 36 facing towards the stationary core 2 (lower side in FIG. 1). The conducting members 34 and 36 are in electrical communication with connection terminals 28 and 40 which are exposed to the outside of the device for connecting the normally closed contact set 28 into the circuit to be switched, and are suitably mechanically rigidly fixed to the aforementioned insulating frame 22, by means such as brackets 27 of any suitable material, fixed via screws 33 to the frame 22, and to which the conducting members 34 and 36 are suitably mechanically fixed by means such as screws 35. Resiliently supported in the windows 20 to either side of the central contact arm 26, by means of compression springs 25 which apply a contact force in the closed circuit state, are movable contact arms 42 made of an electrically conductive material, disposed in parallel with, but vertically displaced in the direction of the stationary core 2 (downwards in FIG. 1) from the aforementioned central contact arm 26, and carrying at each end thereof on the surface thereof facing towards the stationary core 2 (lower side, in FIG. 1), movable contacts 46 of normally open contact sets 44, which are normally maintained in the open state with the movable contacts 46 out of contact with stationary contacts 48 individually supported opposite the movable contacts 46 on the surfaces of conducting members 49, 50, 51 and 52 facing away from the stationary core 2 (upper side in FIG. 1). The conducting members 49, 50, 51 and 52 are in electrical communication with connection terminals 53, 54, 55 and 56, which are exposed to the outside of the device, for connecting the normally open contact sets 44 into the respective circuits to be switched, and are suitably mechanically rigidly fixed to the aforementioned insulating frame 22. The terminals 38, 40, 53, 54, 55 and 56 may comprise any suitable terminal mechanism, such as screws 58 which screw down to clamp a connected lead (not shown) to the respective conducting member 34, 36, 49, 50, 51 or 52, as in the embodiment illustrated in FIGS. 1–5.

Figure 5:
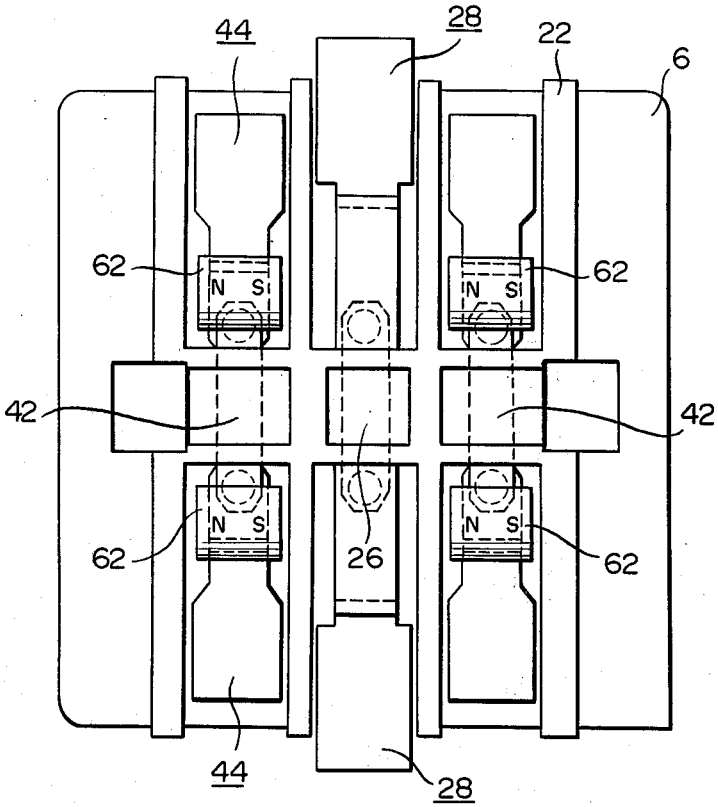
FIG. 5 is a plan view of the magnetic arc-extinguishing means according to this invention showing the positions of the permanent magnets.

Mechanically rigidly clamped to inside depressions 72 formed in the upper inside portion of an insulating inspection cover 70, by clamping plates 64, which also serve as arc horns, secured to the cover 70 by screws 66 threadably engaged with the clamping plates 64 from outside the cover 70 through holes 68 provided therein, are four permanent magnets 62, which, together with the clamping plates 64 and the cover 70, constitute an arc-extinguishing device 60, disposed adjacent to the aforementioned contact sets 44 and 28. The permanent magnets 62 are disposed such that their directions of magnetization are the same, as shown in FIG. 5, and such that when the insulating inspection cover 70 is in place, one of four magnets 62 lies substantially vertically above each contact pair, consisting of a stationary contact 48 and a movable contact 46 on one side of a normally open contact set 44, such that the flux generated between north and south poles of each individual magnet 62 passes through a gap formed between the opened contacts 46 and 48 of the adjacent contact pairs. The magnets 62 are also disposed such that magnets 62 on opposite sides of a contact pair at one end of the centrally disposed normally closed contact set 28 face each other with opposite pole faces such that flux is generated therebetween which passes through a gap formed between the contacts 30 and 32 of the contact pairs at each end of the centrally disposed normally closed contact set 28 when they are opened. The inspection cover 70 is disposed around the central shaft portion 18 of the cross-bar 14, and is removably fixed to the aforementioned insulating frame 22 by screws 74 which engage through tabs 76 extending laterally beyond the periphery of the cover 70, with threaded holes (not shown) formed in the frame 22, enabling the cover 70 to be removed for inspection of and attention to the contact sets 24 and 44 contained within the device. Formed integrally with the aforementioned insulating frame 22 is an arc cooling barrier 78 which projects upwards in the drawing from an internal portion of the insulating frame 22 to closely surround and protect the shaft portion 18 of the cross-bar 14 beneath the normally closed contact set 28, and to cool arcs that develop at the time of separation of the normally closed contact set, and also integrally formed with the insulating frame 22 at a position laterally displaced from the normally open contact set 44 is a further arc cooling barrier 80 which functions to cool arcs developing at the separation of the normally open contact set 44.

In this preferred embodiment of the present invention, the magnetic flux density in the vicinity of the contact pairs affected by the magnetic flux is fixed at between 150 and 400 gauss.

Next the operation according to the above described embodiment will be described.

When the electromagnetic contactor is in the normal position with the electromagnetic coil 8 unenergized the normally open contact sets 44 are open and do not pass current, while the normally closed contact set 28 is closed and does pass current in the circuit into which it is connected. Then electric power is switched to be supplied from a power source (not shown) to the aforementioned electromagnetic coil 8, the electromagnetic coil 8 thus generating an electromagnetic force in the stationary core 2 about which it is disposed. This electromagnetic force in the stationary core 2 acts to attract the movable core 10 which is thus drawn, together with the cross-bar 14 to which it is fixed, against the force of the return spring (not shown) towards the stationary core 2. As the cross-bar 14 moves in the direction of the stationary core 2, it brings with it the normally closed contact set 28 and normally open contact set 44 contact arms 26 and 42 supported in the windows 20 in the shaft portion 18 of the cross-bar 14, first causing the contact between the stationary contacts 32 and the movable contacts 30 of the normally closed contact set 28 to be broken putting the normally closed contact set 28 into the open circuit state. The travel of the movable core 10 and the attached cross-bar 14 ceases when the movable core makes physical contact with the stationary core 2. Any shock caused by the impact of this contact is absorbed by the shock absorbing spring 4 on which the stationary core 2 is mounted. At the end of this travel, contact is made between the stationary contacts 48 and the movable contacts 46 of the normally open contact sets 44, placing these contact sets 44 in the closed circuit state and causing current to be passed in the circuits into which they are connected. Then the power being supplied to the electromagnetic coil 8 may be switched off at any suitable or desired time, whereupon the electromagnetic force generated in the stationary core 2 due to the excitation of the coil 8 is ceased, and the movable core 10 is released such that the movable core 10 and the cross-bar 14 are returned to the normal position with the yoke portion 16 of the cross-bar 14 retained by the retaining flange portion 23 of the insulating frame 22, by the pressure of the return spring (not shown) acting on the cross-bar 14. When the cross-bar 14 is returned it carries with it the contact arms 26 and 42 supported in the window 20 thereof, and thus the contact of the normally open contacts 46 and 48 of the normally open contact sets 44, which had been placed in the closed state by the movement due to electromagnetic attraction of the cross-bar 14, is broken, returning the normally open contact sets 44 to the open state. Similarly the normally closed contact sets 28 are returned from the open state to the closed state.

When any of the sets of contacts 28 and 44 is released or moved from the closed to the open circuit state due to the relevant movement of the cross-bar 14 in accordance with the energization or deenergization of the coil 8, an arc may tend to be formed between the separating contacts 30 and 32 or 46 and 48, due to the current passing therethrough. However, these arcs are controlled and extinguished by the arc-extinguishing devices 60 described above, in accordance with an operation as illustrated in FIGS. 6–8, and as explained hereinbelow.

Figure 6:
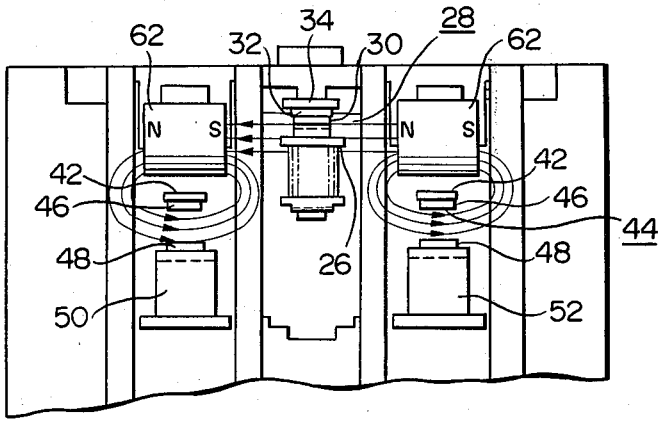
FIG. 6 is a side view of the magnetic arc-extinguishing means according to this invention, showing the fluxes thereof.
Figure 7:
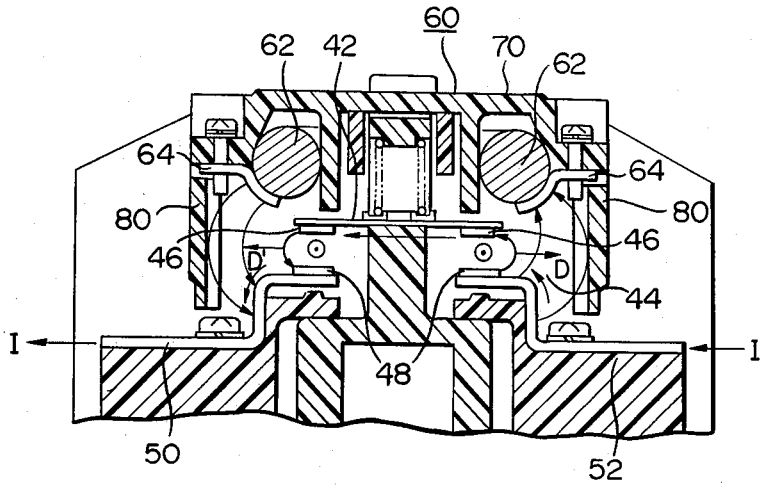
FIG. 7 is a sectional side view of the direct current electromagnetic contactor according to this invention illustrating the action of the normally open contacts when they are opened after closure.

By disposing the permanent magnets 62 as shown in FIG. 5, the magnetic flux due to the permanent magnets 62 takes the form shown in FIG. 6, and the arcs produced by the opening of the closed normally open contact sets 44 due to the deenergization of the electromagnetic coil 8, are produced in a direction at right angles to the direction of the magnetic flux, and so are driven in the directions shown by the arrows D and $D_1$ in FIG. 7 in accordance with Fleming's left-hand rule (the arrows marked I indicate the direction of the current, and arrows seen head-on (a dot in a circle ⊙) or tail-on (a cross in a circle ⊗) (in FIG. 8) indicate the direction of the magnetic flux), and are thus drawn out and cooled by the surface of the arc cooling barriers 80, whereby the extinguished of the arc is promoted. Arc-extinguishing is further aided by the clamping plates 64 which also serve as arc horns to move the legs of the arcs.

Figure 8:
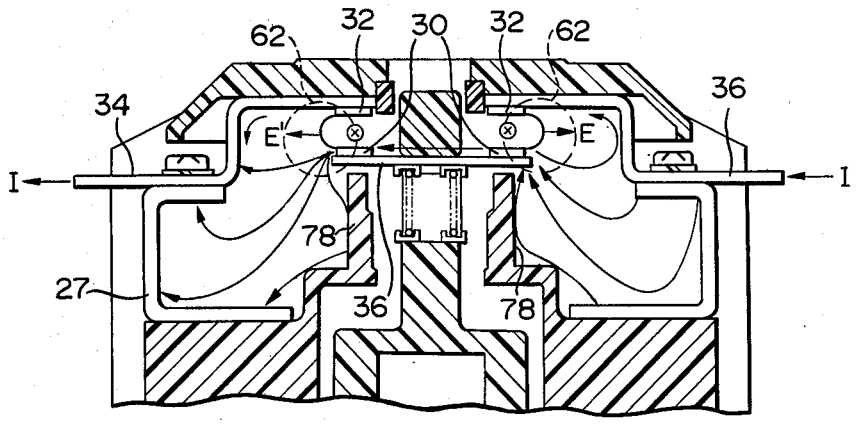
FIG. 8 is a sectional side view of the direct current electromagnetic contactor according to this invention illustrating the action of the normally closed contacts when they are opened after closure.

Similarly, when arcs are produced across the contacts 30 and 32 of the normally closed contact set 28 by the opening of the closed normally closed contact set 28 due to the energization of the electromagnetic coil 8, these are produced in a direction at right angles to the direction of the magnetic flux as shown in FIG. 8, and so, in accordance with Fleming's left-hand rule they are driven in the directions of the arrows marked E and E', and are drawn out to be cooled by the surface of the arc cooling barriers 78, whereby arc-extinction is promoted.

There now follows some explanation with regard to the relation between arc voltage and flux density as a preamble to the description of how interruption performance has been improved and, how the device has been reduced in size by the construction according to this invention.

Figure 9:
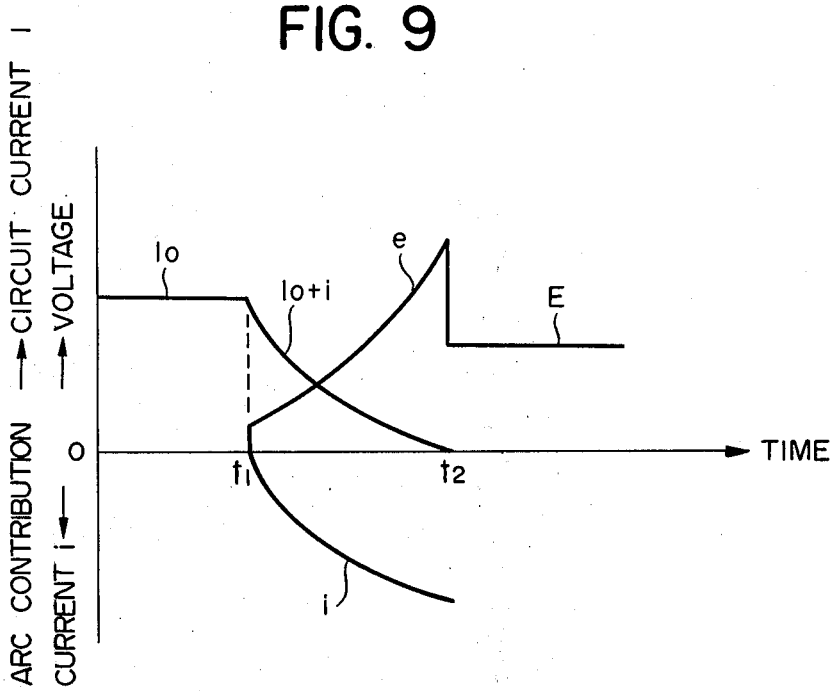
FIG. 9 is a graph showing the general relationship of circuit current and arc voltage characteristics, against time.

FIG. 9 shows characteristics curves illustrating the relationship between the circuit current I and the arc voltage e with regard to time. Up until the time $t_1$ when the contacts open, a normal current $I_o$ flows in the circuit. Then an arc is produced by the opening of the contacts and an arc voltage e is produced between the contacts, and the sum circuit current I of a current i due the arc and the normal current $I_o$ is produced and flows in the circuit. With the passing of time, the current I diminishes, reading zero at the time point $t_2$, and the arc is extinguished. During that time, the arc voltage e rises as the arc grows in length in accordance with the widening gap between the contacts. With the extinction of the arc, the circuit voltage E (source voltage) is applied across the contacts. Here, the contribution current i due to the arc is expressed by the following:

$$i \approx e/R(1-\epsilon^{-(R/L)t}) \quad \text{(I)}$$

where:

R: circuit resistance (Ω)

L: circuit inductance (H)

$t=t_2-t_1$: arcing time (s)

e: arc voltage (V)

i.e.: If the circuit time constant (L/R) is of a fixed value, the contribution current i will be in proportion to the arc voltage e.

However, when the arc is produced within a magnetic field in a direction at right angles to the direction of magnetization, the arc driving force expressed by the following is produced with regard to the arc.

$$F=B \cdot I \cdot l \quad \text{(II)}$$

wherein:

B: Flux density

I: Arc current l: Arc length (in this case, the distance between the contacts)

i.e.: The arc driving force F is proportional to the flux density B when the current I and arc length l are fixed. Accordingly, if the arc driving force F is increased by raising the flux density B, when the distance between the contacts is fixed, the arc will be drawn out and the arc voltage will rise.

Further, the arcing time t may be given by the following expression derived from expression (I) above.

$$t = \frac{L}{R} \log\epsilon \left(1 - \frac{R \cdot i}{e}\right) \quad \text{(III)}$$

Accordingly the arc energy E is:

$$E = e \cdot (I_o + i) \cdot t \quad \text{(IV)}$$

$$= \frac{e \cdot t}{R} (V + e) \left(1 - \epsilon^{-\frac{R}{L} t}\right)$$

$$= \frac{e^2}{R} \cdot t(K + 1) \left(1 - \epsilon^{-\frac{R}{L} t}\right)$$

wherein K: V/e is constant. i.e.: The arc energy E is proportional to the square of the arc voltage e.

Figure 10:
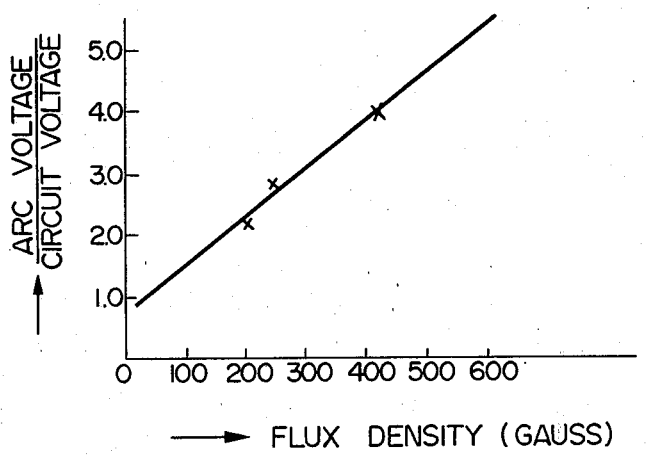
FIG. 10 is a graph illustrating the general relationship of arc voltage characteristics to flux density.

Generally, reducing the arc energy E by reducing the arc voltage e is related to making the direct current electromagnetic contactor small, but in order to interrupt the arc it is necessary to make the arc voltage at least 1.5 times the circuit voltage V. The results of experiments with regard to the relationship between the arc voltage e and flux density in the range of circuit voltages DC 220 V–440 V and circuit currents 30A–300A are shown graphically in FIG. 10. Namely, with the flux density in the range 150–350 gauss, it was determined that the arc voltage becomes 1.7 to 3.5 times the circuit voltage V.

In an embodiment of this invention the flux densities between the contacts are all set between 150 and 400 gauss, and so sufficient arc voltage can be obtained as necessary, and the overall dimensions of the device can be reduced.

Figure 11:
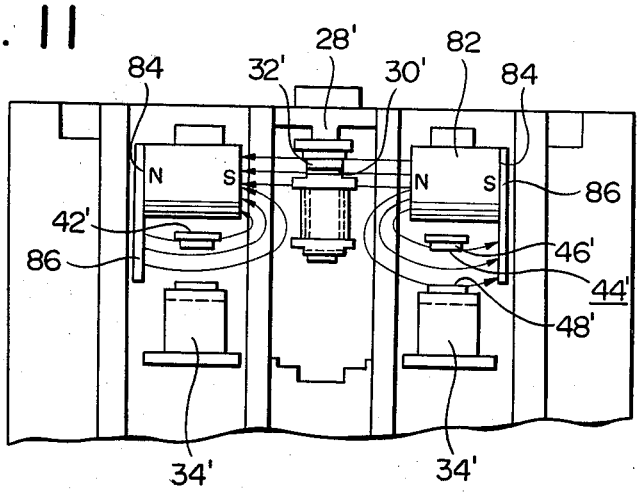
FIG. 11 is a side view of another embodiment of a direct current electromagnetic contactor according to this invention, also showing the magnetic fluxes.

FIG. 11 shows a portion of another embodiment of this invention wherein to the outwardly facing poles 84 of the permanent magnets 82 are fixed pole tabs 86 the ends of which are adjacent to the contacts 46' and 48' of the normally open contact sets 44', whereby the device is capable of being further reduced in size. Also, when the direct current electromagnetic contactor is of a large capacity, it is possible to make use of this invention by increasing the length of the permanent magnets (62 or 82) and by using permanent magnets with a large residual flux density B and high coercive force H characteristics.

As described hereinabove, in accordance with this invention it is possible to reduce manufacturing costs by simplifying the construction of the arc-extinguishing device by eliminating the pole plates of the prior art and by fixing the permanent magnets which act between the contacts, to the interior surface of the inspection cover, as in this invention, and by reducing the number of permanent magnets used by arranging the magnets which act on the contacts of the normally open contact sets such that the flux of the permanent magnets which acts on the contacts of the normally open contact sets also acts on the contacts of the normally closed contact sets. Further, by eliminating the pole plates of the prior art, the reduction in magnetic drive force due to the transfer of the arc to the pole plates, during arc interruption, is prevented, and so it is possible to provide an inexpensive direct current electromagnetic contactor of outstanding interruption performance. Furthermore, since, according to this invention, the arc is cooled by a barrier formed of an insulating material, the interruption performance is further improved; and by making the flux density between the contacts 150–350 gauss, a sufficient arc voltage can be obtained as necessary, so enabling a direct current electromagnetic contactor of outstanding interruption performance to be provided at relatively low cost.

Figure 12:
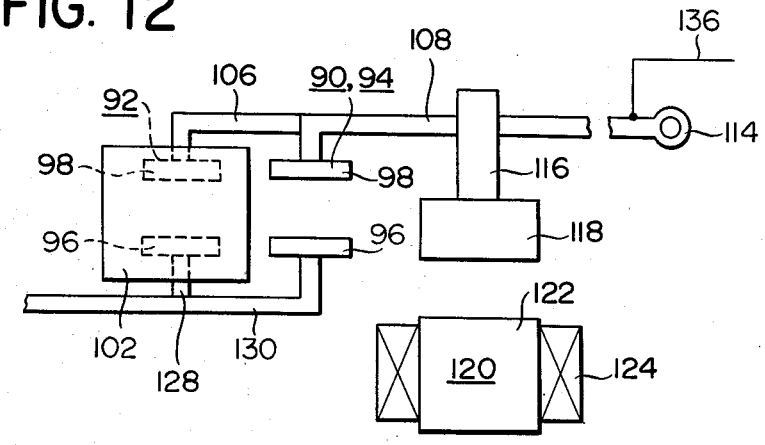
FIGS. 12 and 13 are schematic side and plan views, respectively, of another embodiment of the present invention.
Figure 13:
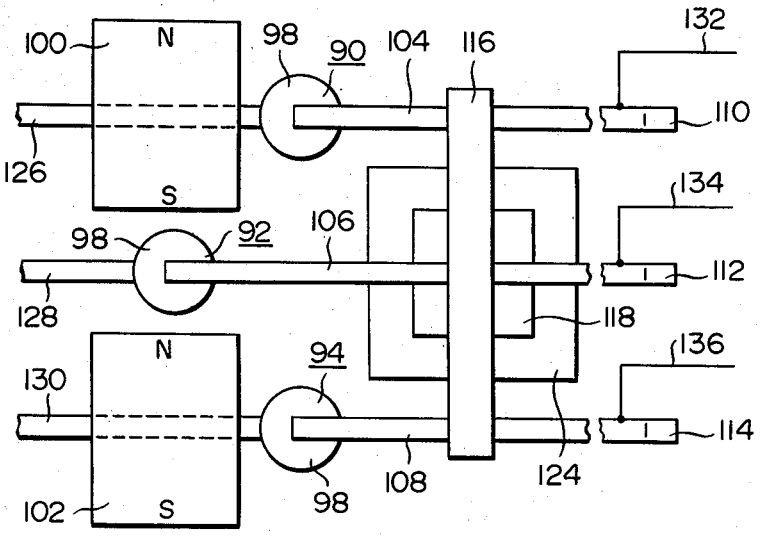

FIGS. 12 and 13 schematically illustrate a modification of the present invention. It is seen in the Figures that only main components of the direct current electromagnetic contactor of the invention are schematically shown and other parts are eliminated. In this embodiment, only a single set of three separable contact pairs 90, 92 and 94 each including a stationary contact 96 and a movable contact 98 is provided, and only a single pair of permanent magnets 100 and 102 is provided. The movable contacts 98 are movably supported by respective contact arms 104, 106 and 108 carrying at one end thereof the movable contacts 98 and pivotably supported at stationary pivot points 110, 112 and 114. All of the contact arms 104, 106 and 108 are connected together by a common insulating cross bar 116 which in turn is connected to a magnetic armature 118 of a magnetic device 120 including a magnetic core 122 and a coil 124 wound around the core 122. The stationary contacts 96 are supported by and electrically connected to the respective terminals (not shown) for connection to an external circuit to be controlled by electrical conductors 126, 128 and 130. The movable contact arms 104, 106 and 108 are also electrically connected to the respective terminals (not shown) by suitable well-known flexible conductors 132, 134 and 136.

It is also to be noted that all of the separable contact pairs of 90, 92 and 94 are of normally open type in which the contacts are normally held separated by a return spring (not shown) and they are moved into the closed positions upon the energization of the magnetic device 120. Also, differing from the embodiment previously described, two contact pairs 90 and 94 on each side of the centrally disposed contact pair 92 are positioned at substantially the same level as seen in FIG. 12.

What is claimed is:

1. A direct current electromagnetic contactor comprising in an insulating housing:

a set of three pairs of separable contacts each pair including stationary and movable contacts and being connectable to an external circuit;

supporting means for movably supporting said movable contacts between closed and open positions relative to said stationary contacts;

operating means including an electromagnetic device operatively coupled to said supporting means for moving, together with said supporting means, said movable contacts between the closed and open positions; and magnetic arc blowout means including at least one pair of permanent magnets each having opposing magnetic pole faces and disposed in the proximity of said separable contact pairs, said permanent magnets being supported by said housing with their pole faces having different magnetic polarities facing each other with an air gap therebetween;

one of said separable contact pairs being positioned within said air gap between said facing pole faces of said permanent magnets with the direction of the movement of said movable contact thereof substantially perpendicular to the magnetic flux lines extending between the facing pole faces of said permanent magnets;

two others of said separable contact pairs each being positioned within a space defined between planes including each magnetic pole face of each permanent magnet with the direction of movement of said movable contacts thereof substantially perpendicular to the magnetic flux lines extending between the opposing pole faces of the respective permanent magnets.

2. A direct current electromagnetic contactor as claimed in claim 1, wherein said supporting means includes an insulating support member arranged for a translational movement along a substantially straight line to effect the contact movement between the closed and open positions.

3. A direct current electromagnetic contactor as claimed in claim 1, wherein said supporting means includes an insulating support member arranged for a pivoting movement about an axis to effect the contact movement between the closed and open positions.

4. A direct current electromagnetic contactor as claimed in claim 1 or 3, wherein said supporting means supports three electrically conductive bridging contact arms in a spaced parallel relationship, said bridging contact arms each carrying said movable contacts one at each of the opposite ends thereof, forming two sets of three contact pairs each set at the respective end sides of said parallel bridging contact arms, and said magnetic arc blowout means including two pairs of said permanent magnets each for each of said contact pair sets.

5. A direct current electromagnetic contactor as claimed in claim 1, 2 or 3, wherein at least one of said separable contact pairs in said contact pair set is of normally closed type and the remaining one of said contact pairs, if any, is of normally open type.

6. A direct current electromagnetic contactor as claimed in claim 4, wherein at least one of said separable contact pairs in said contact pair set is of normally closed type and the remaining one of said contact pairs, if any, is of normally open type.

7. A direct current electromagnetic contactor as claimed in claim 1, 2 or 3, wherein all of said separable contact pairs in said contact pair sets are of normally open type.

8. A direct current electromagnetic contactor as claimed in claim 4, wherein all of said separable contact pairs in said contact pair sets are of normally open type.

9. A direct current electromagnetic contactor as claimed in claim 1, 2, or 3, further comprising means including an electrically insulative barrier disposed adjacent to said magnetic arc blowout means for cooling an elongated electric arc contacting said barrier.

10. A direct current electromagnetic contactor as claimed in claim 4, further comprising means including an electrically insulative barrier disposed adjacent to said magnetic arc blowout means for cooling an elongated electric arc contacting said barrier.

11. A direct current electromagnetic contactor as claimed in claim 1, 2, or 3, wherein the flux density in the area defined between said movable and stationary contacts of each of said contact pairs when they are separated is selected to be from 150 to 400 gauss.

12. A direct current electromagnetic contactor as claimed in claim 4, wherein the flux density in the area defined between said movable and stationary contacts of each of said contact pairs when they are separated is selected to be from 150 to 400 gauss.

13. A direct current electromagnetic contactor as claimed in claim 6, further comprising means including an electrically insulative barrier disposed adjacent to said magnetic arc blowout means for cooling an elongated electric arc contacting said barrier.

14. A direct current electromagnetic contactor as claimed in claim 8, further comprising means including an electrically insulative barrier disposed adjacent to said magnetic arc blowout means for cooling an elongated electric arc contacting said barrier.

15. A direct current electromagnetic contactor as claimed in claim 6, wherein the flux density in the area defined between said movable and stationary contacts of each of said contact pairs when they are separated is selected to be from 150 to 400 gauss.

16. A direct current electromagnetic contactor as claimed in claim 8, wherein the flux density in the area defined between said movable and stationary contacts of each of said contact pairs when they are separated is selected to be from 150 to 400 gauss.

17. A direct current electromagnetic contactor as claimed in claim 10, wherein the flux density in the area defined between said movable and stationary contacts of each of said contact pairs when they are separated is selected to be from 150 to 400 gauss.

* * * * *